United States Patent [19]

Meyer

[11] 4,139,214

[45] Feb. 13, 1979

[54] SKI

[76] Inventor: Hans Meyer, Säntisstrasse 9, 8000 Munich 82, Fed. Rep. of Germany

[21] Appl. No.: 760,820

[22] Filed: Jan. 19, 1977

[30] Foreign Application Priority Data

Jan. 20, 1976 [DE] Fed. Rep. of Germany ..... 2601951
Aug. 2, 1976 [DE] Fed. Rep. of Germany ..... 2634748

[51] Int. Cl.[2] ..... A63C 5/00

[52] U.S. Cl. ..... 280/607; 267/160; 280/617

[58] Field of Search ..... 280/607, 602, 617, 618, 280/615, 614, 636, 633; 267/30, 31, 32, 160, 164

[56] References Cited

U.S. PATENT DOCUMENTS

| | | | |
|---|---|---|---|
| 3,260,532 | 7/1966 | Heuvel | 280/602 |
| 3,797,839 | 3/1974 | Smolka et al. | 280/617 |
| 4,002,354 | 1/1977 | Ramer | 280/618 |

FOREIGN PATENT DOCUMENTS

| | | | |
|---|---|---|---|
| 79115 | 11/1919 | Austria | 280/618 |
| 2259375 | 6/1974 | Fed. Rep. of Germany | 280/607 |
| 433850 | 4/1948 | Italy | 280/636 |
| 28793 of | 1898 | United Kingdom | 280/633 |

*Primary Examiner*—David M. Mitchell
*Attorney, Agent, or Firm*—Oblon, Fisher, Spivak, McClelland & Maier

[57] ABSTRACT

A ski is equipped in the middle section of its surface area with a spring board, mounted in an axial direction, whose front part is affixed rigidly to the ski, being fastened in or supported in such a way that a hinged leg, which carries the ski-binding and which adjoins in a rearward direction, can perform resilient swing movements, and which exerts a torque on the ski if the proper stress is exerted, which tends to lift the front part of the ski and to weigh down the rear.

12 Claims, 11 Drawing Figures

SKI

BACKGROUND OF THE INVENTION

1. Field of the Invention

The present invention relates generally to skis, and more particularly to an improved ski which is adjustable to suit the skier's weight and ability as well as to adapt to snow conditions.

2. Description of the Prior Art

For the presently known ski, the transmission of force takes place directly from the skier, via the boots and the binding, to the ski. The resilient effect of the ski has been created heretofore by its construction and a more or less intense initial stress during production. Also, there are skis known which contain a device that allows the changing of stress minimally in the direction of the longitudinal axis. While sking, the execution of changes in direction are accomplished by exercising a certain technique, mostly by changing the weight from one ski to the other, irregardless of the individual skiing expertise.

Furthermore, it is known that the ski binding is mounted to the ski in such a way that the weight of the skier is shifted minimally to the rear part of the ski. This means that the front part of the ski is slightly relieved, while the rear is weighed down somewhat more. Specifically, for the skiing technique in deep snow condition, it is necessary to relieve the front of the skis considerably, to allow execution of directional changes to be made more easily. The necessary strong relief can be achieved, however, by an extreme leaning back on the skis, a position which endangers the security and the equilibrium of the skier.

Beyond this, directional changes, initiated by the skier, are dependent upon the transmission of force onto the ski and upon the resulting torque. The exertion of force for the torque, which will bring about a change in direction, relies mainly upon the ability and the technique of the skier, the elastic deformation of the ski, the friction between the running surface of the ski and the snow, and on the friction and displacement of the snow itself.

One disadvantage of the presently known ski is that the spring effect thereof is rather low, for instance, on a smooth slope, on new snow and on deep powder snow. It is also disadvantageous that the torque necessary for the execution of a directional change ensues from the skier through boots and bindings to the ski. Beyond this, the presently known ski also has the drawback that, due to its low resiliency, the ski transmits the hits and blows which occur while skiing on hard, rippled, icy and bumpy slopes and which are transferred directly to the boots and the skier. From a medical standpoint, there have therefore recently been major objections against alpine skiing, since spinal disk problems and other physical damages frequently occur.

SUMMARY OF THE INVENTION

An object of the present invention is to provide a ski that offers positive performance and which allows the skier to change direction more easily and also can be adjusted to his weight, technique, ability and the snow conditions.

The foregoing objects and others as well are attained, according to the present invention, through the provision of a ski which is equipped in its center area with a spring board that is aligned with the ski in the longitudinal direction thereof. A front hinged leg of this device is connected with the ski in such a way that the rear hinged leg, which is adjacent to the front one and carries the binding, can produce a resilient vertical swinging movement with a limited pitch.

The advantages received from this invention consist mainly in a major increase in the ability to distribute weight on the ski, achieved by the spring effect, and the facilitating of directional changes. A further advantage consists of the fact that a torque is provided, and the leverage from which it originates works in such a way that, through the elastic deformation of the ski, a relief takes place before the point of contact between the spring board and the ski, and weighing down behind this point, all of which allows easier turns to be made, especially in deep and new snow. Furthermore, the spring board produces a leverage which produces a torque parallel to the ski running surface, which allows for turns to be made with less effort. Beyond this, the spring board dampens blows which occur, especially on hard, icy and bumpy slopes and allows for smoother skiing, and also protects the bone structure of the skier. Through the advantageous properties of the ski device of this invention, the consumption of force is reduced considerably, so that fatigue sets in at a later point than normal and thereby the safety factor is enhanced while skiing.

A special practical advantage is the fact that the front hinged leg can be a semi-circular or J-shaped leaf spring, which is wound around an elastic cylinder, and that at the rear leg of the spring board a ring-shaped leaf spring is attached, which is connected to the end of the spring board with the aid of a turntable hinge.

BRIEF DESCRIPTION OF THE DRAWINGS

Various other objects, features and attendant advantages of the present invention will be more fully appreciated as the same becomes better understood from the following detailed description when considered in conjunction with the accompanying drawings, in which like reference numerals designate like or corresponding parts throughout the several figures, and wherein.

DETAILED DESCRIPTION OF THE ILLUSTRATED EMBODIMENTS

Figure 2:
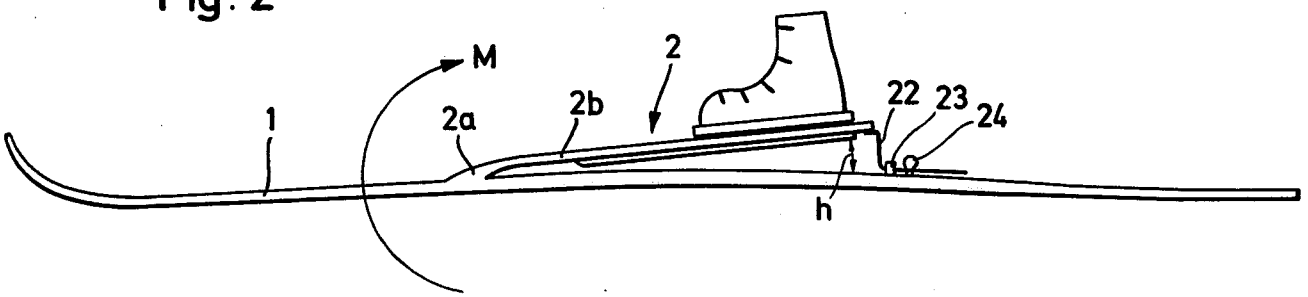
FIG. 2 is a side view of the ski shown in FIG. 1.
Figure 1:
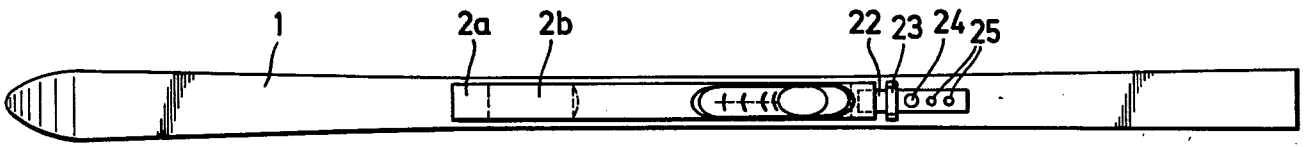
FIG. 1 is a top view of a ski formed according to this invention.

Referring now to the drawings, and more particularly to FIGS. 1 and 2, there is shown a ski 1 and a spring board generally designated by the reference numeral 2 which are of one piece construction, whereby a front hinged leg *2a* of the spring board 2 is connected to the ski 1 at a point about ⅓ down from the top or forward end of the ski. This connection is permanent. The length of a rear hinged leg 2*b* of the spring board, which adjoins the front leg 2*a* thereof, should be about 25–35% of the total length of the ski, while the width of the spring board would coincide roughly with the width of the ski 1 in the area of the binding.

Figure 4:
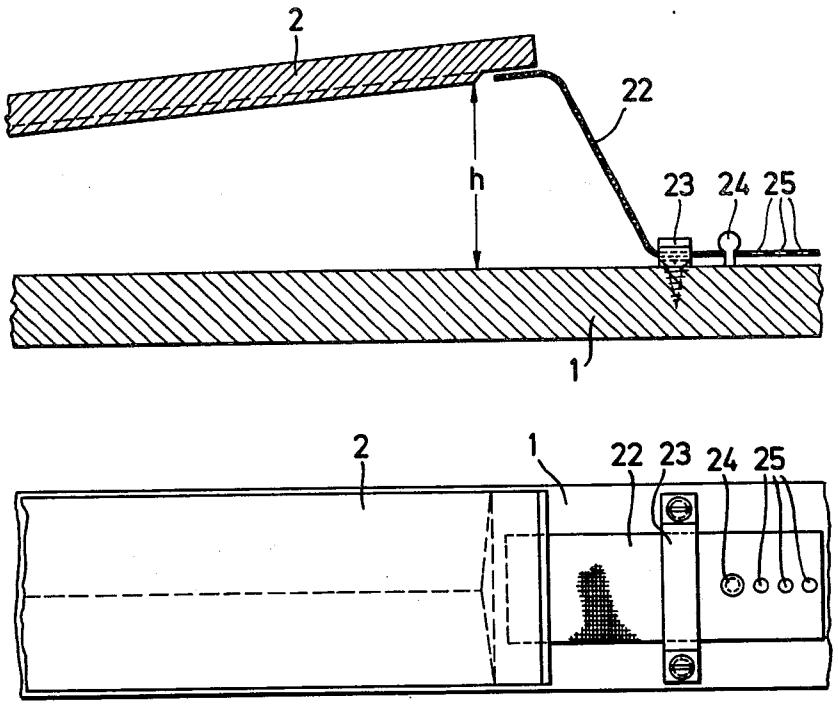
FIG. 4 is a cross-section of the ski shown in FIG. 3.
Figure 4:
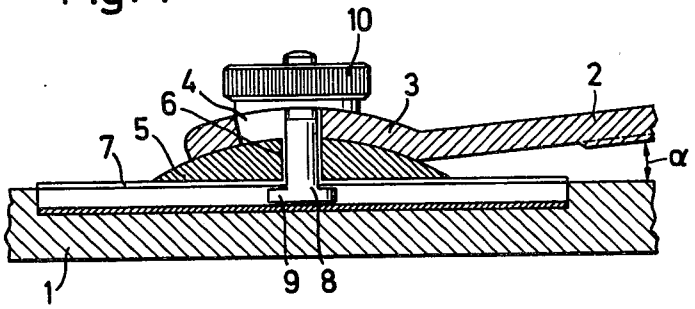
Figure 3:
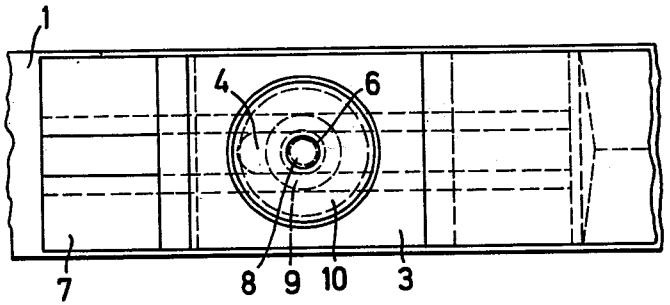
FIG. 3 is a top view of another embodiment of the ski of the present invention.

In the embodiment shown in FIGS. 3 and 4, the spring board 2 consists of an independent unit, whereby its front hinged leg is shown as a hollow cylindrical segment or concave portion 3 which is connected at its point of contact, via a cylinder segment or convex portion 5 and a base plate with profile 7, to the ski 1 by way of a screw 8 and a wheel-shaped nut 10, which allows arresting and loosening. The profile of the base plate 7 is sunk in the longitudinal direction into the ski 1 and holds the top of a screw 9.

In order to lead the screw 8 through it, the cylinder segment 5 contains a borehole 6 and the hollow cylindrical segment 3 a slot 4, placed longitudinally. By loosening the wheel nut 10, it is possible to alter the plane surface of the cylinder segment 5, along the base plate, as well as the inner touching surface of the hollow cylindric segment 3 in relation to the outer touching surface of the cylinder segment 5, whereby the spring board 2 and the ski 1 are forming a variable angle $\alpha$ and a variable pitch h of the spring board 2.

Another embodiment, which is not shown in the drawings, consists of and differentiates itself from the version shown in FIGS. 3 and 4 by a form that has the profile of the baseplate 7, not sunk into the surface of the ski to accommodate the head of the screw 9, but rather by flipping over or inverting the base plate with profile 7, so that it can be placed on the surface of the ski. Then a groove is planed in the hollow cylindrical segment 3 and in the cylinder segment 5 which can accommodate the base plate with profile 7. In either embodiment the pitch h of the spring board 2 is then limited by, for instance as shown in FIGS. 3 and 4, an elastic band 22 which is connected at one end to the rear end of the rear hinged leg 2*b*, and at the other end, which is equipped with a row of holes 25, by way of a guard 23 and a ball-shaped rivet 24, allowing for adjustment longitudinally on the surface of the ski, to the ski surface.

In accordance with another feature of the invention, the adjustable and movable parts of the hollow cylinder segment 3, the cylinder segment 5, and of the base plate with profile 7, could be meshed horizontally to the longitudinal axis of the ski, to avoid slippage when in a fixed position.

To prevent the formation of an accumulation of snow in the gap between the surface of the ski and the bottom of the spring board, at least one of these surfaces is to be shaped like a roof, so that it acts like a wedge as the spring board swings and presses the snow toward the side.

In a further version of a ski, in accordance with the invention, equipped with a spring board, which is not shown in the drawings, the front hinged leg 2*a* of the spring board 2 can be swivel-mounted to the ski 1 at the point of contact. To change the tension of ski 1, that is to say, to reduce the torque M and to change the spring effect, a support is to be mounted adjustably into the area below the spring board 2 in a longitudinal direction that allows the spring board 2 to act as a lever, which attempts to lift the front part of the ski and presses upon the support further back, by way of the point of contact or the pivot.

Figure 6:
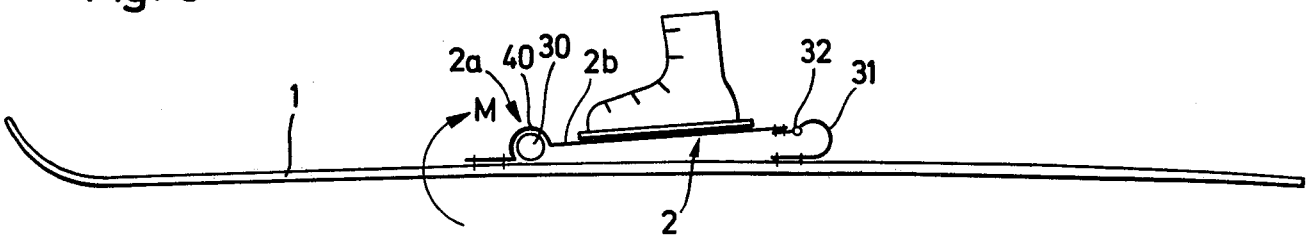
FIG. 6 is a side view of the ski shown in FIG. 5.
Figure 5:
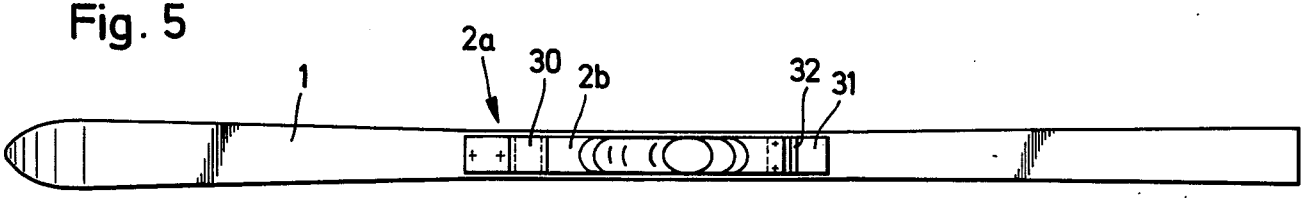
FIG. 5 is a top view of yet a further production version of the present invention.

In FIGS. 5 and 6, the front hinged leg 2*a* is formed as a semi-circular leaf spring 40 including a loop portion to accommodate as elastic cylinder 30. Beyond this, a ring-shaped leaf spring 31 is attached to the ski 1, which is connected by way of a hinge 32 with the rear end of the rear leg 2*b*.

This type of arrangement of the spring board 2 permits better steering and adjusting of the spring action tward the ski 1, while transmitting at the same time a torque M from the spring board 2 to the ski 1. The torque can then be brought to bear on the ski 1 by way of shifting the weight to the rear, letting the spring board 2 act as lever, and by the spring effect of the front leaf spring 40 and of the elastic cylinder 30 made of rubber or the like.

Figure 8:
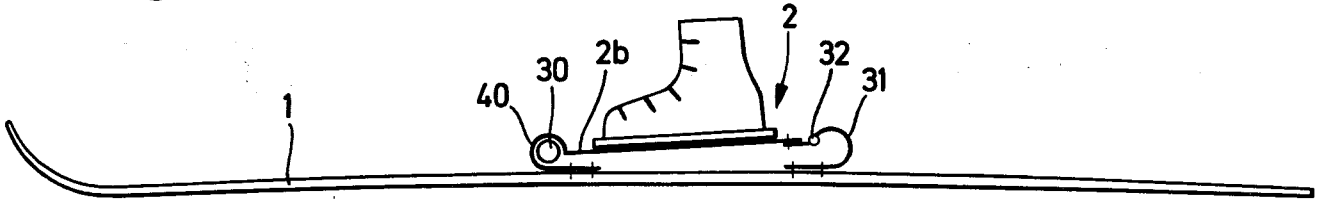
FIG. 8 is a side view of the ski shown in FIG. 7.
Figure 7:
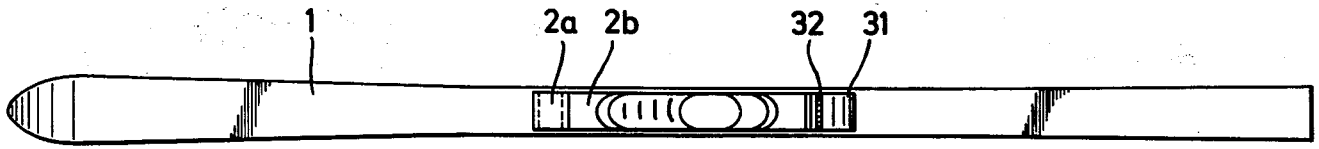
FIG. 7 is a top view of still another production version of the present invention.

A modification of the spring action as presented in FIGS. 5 and 6 is shown in the embodiment of FIGS. 7 and 8, where the front leg 2*a* is presented as a J-shaped leaf spring.

Figure 10:
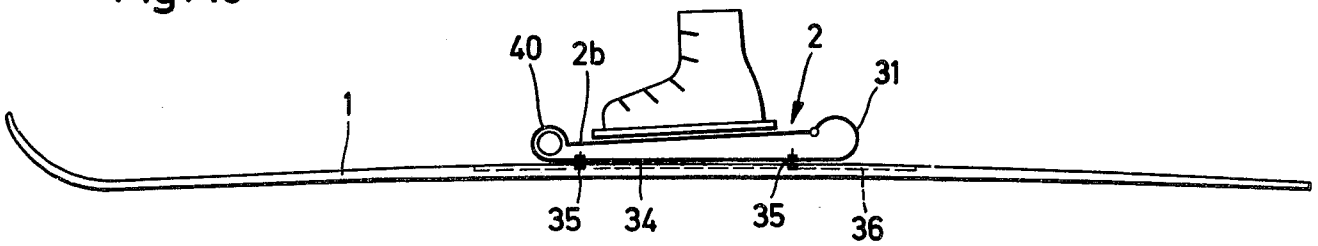
FIG. 10 is a side view of the ski shown in FIG. 9.
Figure 9:
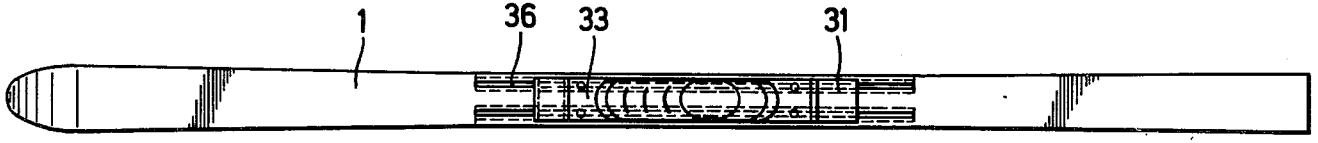
FIG. 9 is a top view of yet another model of the present invention.

As shown in FIGS. 9 and 10, the two leaf springs 31 and 40 could, for instance, be connected to two tracks or a plate 34, so that the leaf springs form a unit with the rear leg 2*b* of the spring board 2. To accommodate screws 25, the two tracks 34 are provided with holes disposed in the longitudinal direction. To connect the two tracks with the ski, the ski is equipped with two profile tracks 36 which are sunken into the ski 1 and intended to receive screws 35. By loosening the screws 35, the spring board 2 becomes adjustable in its longitudinal axis on the ski 1.

Figure 11:
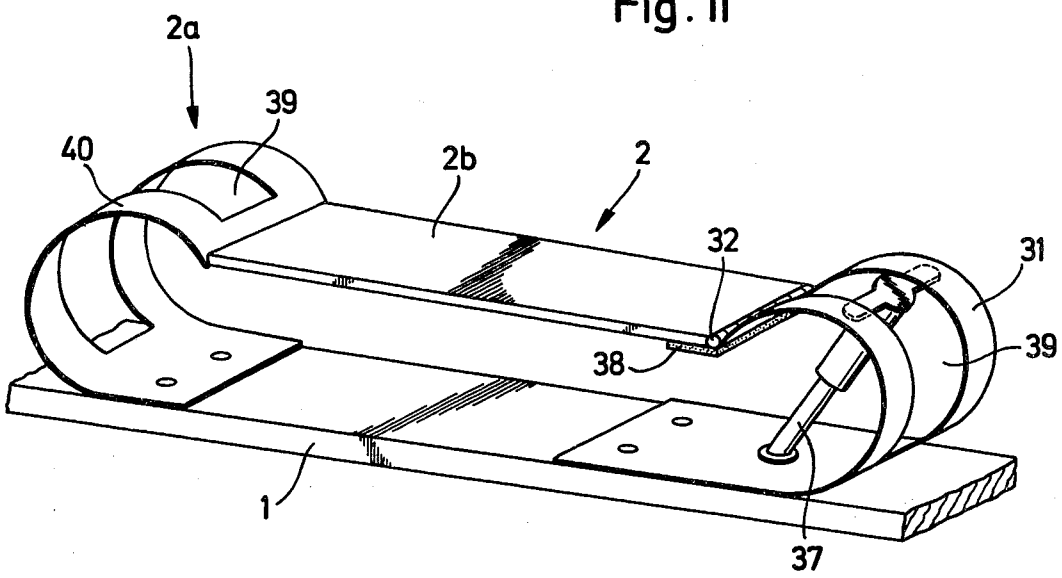
FIG. 11 is a demonstrative projection of even another model version of this invention.

In FIG. 11, certain measures are shown, which will reduce the swinging of the spring board 2, respectively can limit it, and which would change the spring characteristics of the front and rear leaf springs 40 and 31. These measures consist of, for instance, providing the springs with slots 39 and/or an attenuation device 37 such as a hydraulic or pneumatic shock absorber which is interjected, and/or that the rear leg 2*b* of the spring board 2 is equipped at its bottom with a buffer 38 made of an elastic material such as rubber or the like. The rear leaf spring includes a loop portion within which is mounted the attenuation device.

Obviously, many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A ski assembly, which comprises:

a ski;

a spring board, disposed on a central section of said ski, arranged along the longitudinal axis of said ski on an upper surface thereof;

said spring board comprising a front hinged leg connected to said ski; and, a rear hinged leg, for carrying a ski binding, connected to said front leg of said spring board such that said rear hinged leg is vertically swingably movable wherein said hinged front leg of said spring board is a leaf spring J-shaped with respect to the longitudinal axis of said ski and wherein said ski assembly further comprises a rear ring-shaped leaf spring interconnecting said rear hinged leg of said spring board and an upper surface of said ski.

2. A ski assembly as set forth in claim 1, wherein said front hinged leg is connected to said ski about ⅓ of the ski length from the forward end of said ski.

3. A ski assembly as set forth in claim 1, wherein said hinged front leg of said spring board is conformed about an elastic cylinder the longitudinal axis of which is disposed perpendicular to the longitudinal axis of said ski.

4. A ski assembly as set forth in claim 1, wherein said front and rear leaf springs have longitudinal slits formed therein.

5. A ski assembly as set forth in claim 1, further comprising mechanical dampening means connected between said rear leaf spring and the upper surface of said ski for reducing swing of said spring board and for altering spring characteristics of said rear leaf spring.

6. A ski assembly as set forth in claim 1, further comprising fluid dampening means connected between said rear leaf spring and the upper surface of said ski for reducing swing of said spring board and for altering spring characteristics of said rear leaf spring.

7. A ski assembly as set forth in claim 1, further comprising dampening means connected between said rear leaf spring and the upper surface of said ski for altering spring characteristics of said rear leaf spring and buffer means disposed on a lower surface of said rear hinged leg for limiting swing of said spring board.

8. A ski assembly as set forth in claim 1, further comprising support means for said front and rear leaf springs disposed on said upper surface of said ski, through which said front and rear leaf springs may be longitudinally adjustably anchored to said ski.

9. A ski assembly which comprises:

a ski;

a spring board, including a front and rear end portion, supported at a spacing along the longitudinal axis of the ski in its central section on an upper surface thereof, which can achieve vertical swinging movements; and, resilient means connecting said front and rear end portions of said spring board to said ski such that a resilient swinging movement of said spring board is thereby produced wherein said resilient means comprises a leaf spring including a loop portion, and said ski assembly further comprises an elastic cylinder disposed within said loop portion of said leaf spring perpendicular to the longitudinal axis of said ski.

10. A ski assembly as set forth in claim 9, wherein said cylinder comprises a solid cylinder made of rubber material.

11. A ski assembly as set forth in claim 9, wherein said leaf spring is provided with slits.

12. A ski assembly which comprises:

a ski;

a spring board, including a front and rear end portion, supported at a spacing along the longitudinal axis of the ski in its central section on an upper surface thereof, which can achieve vertical swinging movements; and, resilient means connecting said front and rear end portions of said spring board to said ski such that a resilient swinging movement of said spring board is thereby produced wherein said resilient means comprises;

a rear leaf spring including a loop portion; and, a dampening means disposed within said loop portion of said rear leaf spring.

* * * * *